US005153941A

United States Patent [19]

Grilliot et al.

[11] Patent Number: 5,153,941

[45] Date of Patent: Oct. 13, 1992

[54] FIREFIGHTER'S COAT HAVING ADJUSTABLE AND REMOVABLE AND REPLACEABLE CHINSTRAP

[76] Inventors: William L. Grilliot; Mary I. Grilliot, both of 1986 Home Ave., Dayton, Ohio 45417

[21] Appl. No.: 656,841

[22] Filed: Feb. 19, 1991

[51] Int. Cl.[5] ..... A41D 13/00

[52] U.S. Cl. ..... 2/98; 2/81; 2/141 R; 2/DIG. 6

[58] Field of Search ..... 2/81, 85, 96, 98, 100, 2/129, 131, 132, 133, 134, 135, 139, 140, 141 A, 141 R, 142, 143, DIG. 6

[56] References Cited

U.S. PATENT DOCUMENTS

| | | | |
|---|---|---|---|
| 808,543 | 12/1905 | Horak | 2/98 |
| 870,004 | 11/1907 | Winks | 2/98 |
| 3,231,899 | 2/1966 | Seidel | 2/98 |
| 3,805,295 | 4/1974 | Garcia | 2/DIG. 6 |
| 3,914,798 | 10/1975 | O'Keefe | 2/100 |
| 4,507,806 | 4/1985 | Coombs | 2/85 |
| 4,648,137 | 3/1987 | Cooper | 2/141 R |
| 4,959,876 | 10/1990 | Kalaam | 2/81 |

FOREIGN PATENT DOCUMENTS

| | | | |
|---|---|---|---|
| 3424745 | 1/1986 | Fed. Rep. of Germany | 2/141 R |

*Primary Examiner*—Werner H. Schroeder
*Assistant Examiner*—Diana L. Biefeld
*Attorney, Agent, or Firm*—Jacox & Meckstroth

[57] ABSTRACT

A firefighter's coat which has a chin and neck protective member which is adjustably and removably attached to the collar portion of the firefighter's coat. The chin and neck protective member is preferably attached to a plurality of portions of the collar portion by means of hook and pile attachment material or the like.

3 Claims, 1 Drawing Sheet

FIREFIGHTER'S COAT HAVING ADJUSTABLE AND REMOVABLE AND REPLACEABLE CHINSTRAP

BACKGROUND OF THE INVENTION

A firefighter's coat conventionally has a collar which includes a chinstrap which has an end portion secured to a part of the collar.

The chinstrap is positioned adjacent the chin and neck of the firefighter and has an opposite end portion which is releasably attached to another part of the collar. Thus, the chinstrap of a firefighter's coat protects the chin and neck region of the firefighter who wears the firefighter's coat.

Several problems exist with regard to such conventional chinstraps. One problem pertains to the fact that a conventional chinstrap is secured to a given part of the collar portion of a firefighter's coat, and the chinstrap has a free end portion which is attachable to another part of the collar portion. The free end portion of the chinstrap is always attached to the same part of the collar. Some firefighters have short-fat neck chin and regions. Other firefighters have long-thin chin and neck regions. This difference in chin and neck regions of firefighters is not considered in construction and the design and positioning of a chinstap upon the collar of a firefighter's coat. Therefore, a chinstrap of a firefighter's coat usually does not properly accommodate the chin and neck region of the firefighter who wears the firefighter's coat.

Also, when a firefighter employs breathing apparatus or the like, the chinstrap of the firefighter's coat does not properly accommodate for the breathing apparatus. Thus, the chinstrap may not properly protect the chin and neck region of the firefighter while the firefighter employs breathing apparatus or the like.

Also, the chinstrap of a firefighter's coat may become worn and in need of replacement before the firefighter's coat to which the chinstrap is attached is in need of replacement.

It is therefore an object of this invention to provide a chin and neck protective member for a firefighter's coat which chinstrap is adjustable, removable, and replaceable.

It is another object of this invention to provide such a chin and neck protection member for a firefighter's coat which protective member is capable of accommodating for any chin and neck size and configuration of a firefighter.

It is another object of this invention to provide such a chin and neck protective member for a firefighter's coat which chinstrap is capable of accommodating for the use of auxiliary gear which is associated with the firefighter's coat.

Other objects and advantages of this invention reside in the construction of parts, the combination thereof, the method of production and the mode of use, as will become more apparent from the following description.

SUMMARY OF THE INVENTION

This invention comprises a firefighter's coat which includes a chin and neck protective member which is adjustable, removable, and replaceable with respect to the firefighter's coat. The firefighter's coat of this invention comprises firefighting material which is abrasion resistant, heat resistant and moisture resistant. The firefighter's coat of this invention includes a collar which includes the same or substantially the same firefighting material.

The chin and neck protective member of this invention is disclosed herein as being a chinstrap which is preferably attached to the collar of the firefighter's coat at a plurality of portions by means of hook and pile attachment means or the like. The hook and pile fastening means are such that the chinstrap is adjustable upon the collar and removable from the collar. Therefore, the chinstrap can be readily removed and/or adjusted with respect to the collar of the firefighter's coat. The chinstrap can be adjusted angularly, or laterally, or longitudinally upon the firefighter's coat to more properly accommodate for the chin region of the firefighter who wears the firefighter's coat. The chinstrap can be removed and replaced by another chinstrap which more readily accommodates for the chin region of the firefighter who wears the firefighter's coat. The chinstrap can be replaced by another chinstrap when excessive wear or damage occurs in the chinstrap.

DETAILED DESCRIPTION OF THE PREFERRED EMBODIMENT

Figure 1:
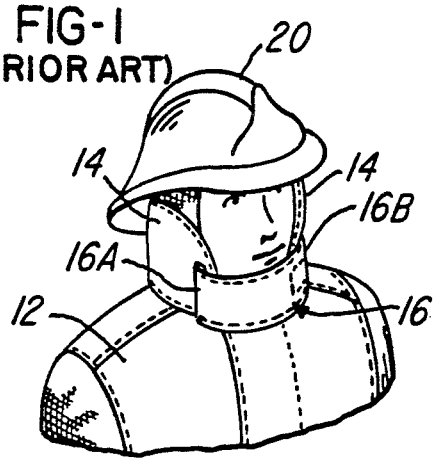
FIG-1 (PRIOR ART)
FIG. 1 is a fragmentary perspective view showing a firefighter wearing a firefighter's coat having a collar to which a conventional chinstrap is attached.

FIG. 1 shows a firefighter wearing a firefighter's conventional coat 12 having a collar 14 and a chinstrap 16. FIG. 1 also shows a helmet 20 upon the head of the firefighter. The collar 14 has a right side portion and a left side portion. The chinstrap 16 has an end portion 16A secured to the right side portion of the collar 14 by stitching or the like. The chinstrap 16 also has an opposite end portion 16B which is attached to the left side portion of the collar 14 by releasable means, such as hook and pile means or the like.

The chinstrap 16 is thus secured to a portion of the collar 14, with the end portion 16B of the chinstrap 16 being attachable to another portion of the collar 14. Therefore, the chinstrap 16 is a fixed part of the firefighter's coat 12 and is used by the firefighter who wears the firefighter's coat 12 as a means of protection of the firefighter's neck and chin region.

A problem exists in that the chinstrap 16 may not be suitable for the firefighter who wears the firefighter's coat 12. The chinstrap 16 may be too wide or too narrow with regard to the chin and neck region of the firefighter Furthermore, the relationship of the chinstrap 16 with respect to the chin and neck region of the firefighter may be such that the chinstrap 16 is uncomfortable to the firefighter who wears the firefighter's coat 12.

Therefore, it is understood that the conventional chinstrap 16 may not be proper for the firefighter who wears the firefighter's coat 12.

FIGS. 2–8 pertain to a firefighter's coat 30 of this invention. The firefighter's coat 30 of this invention includes a collar 34, having a right side portion 34R and a left side portion 34L. The right side portion 34R of the collar 34 includes a body 38 of hook and pile material. Also, the right side portion 34R of the collar 34 has a short flap 40 attached thereto The short strap 40 is shown as being secured to the right side portion 34R of the collar 34 by stitching or the like. Secured to the short flap 40 is a body 44 of hook and pile material.

A chin and neck protective member in the form of chinstrap 50 has an end portion 50A. A body 54 of hook and pile material is secured to one surface of the end portion 50A, and a body 56 of hook and pile material is secured to the opposite surface of the end portion 50A of the chinstrap 50.

The body 56 of hook and pile material which is secured to the end portion 50A of the chinstrap 50 is complementary to the body 38 of hook and pile material which is secured to the right side portion 34R of the collar 34. Thus, the body 56 of hook and pile material, which is secured to the end portion 50A of the chinstrap 50, is releasably attachable to the body 38 of hook and pile material, which is secured to the right side portion 34R of the collar 34. Also, the body 54 of hook and pile material which is secured to the end portion 50A of the chinstrap 50 is releasably attachable to the body 44 of hook and pile material which is secured to the flap 40 which is secured to the right side portion 34R of the collar 34. Therefore, the flap 40 covers the end portion 50A of the chinstrap 50 as both surfaces of the end portion 50A are attached to the right side portion 34R of the collar 34. Thus, the end portion 50A of the chinstrap 50 is readily and easily releasably and firmly attached to the right side portion 34R of the collar 34.

Figure 2:
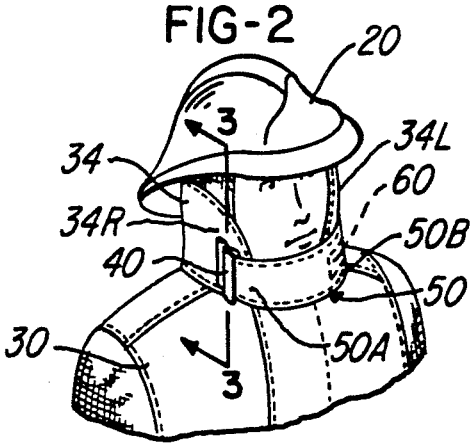
FIG. 2 is a fragmentary perspective view, similar to FIG. 1, showing a firefighter wearing a firefighter's coat of this invention, in which the firefighter's coat has a collar to which a chinstrap of this invention is attached.
Figure 4:
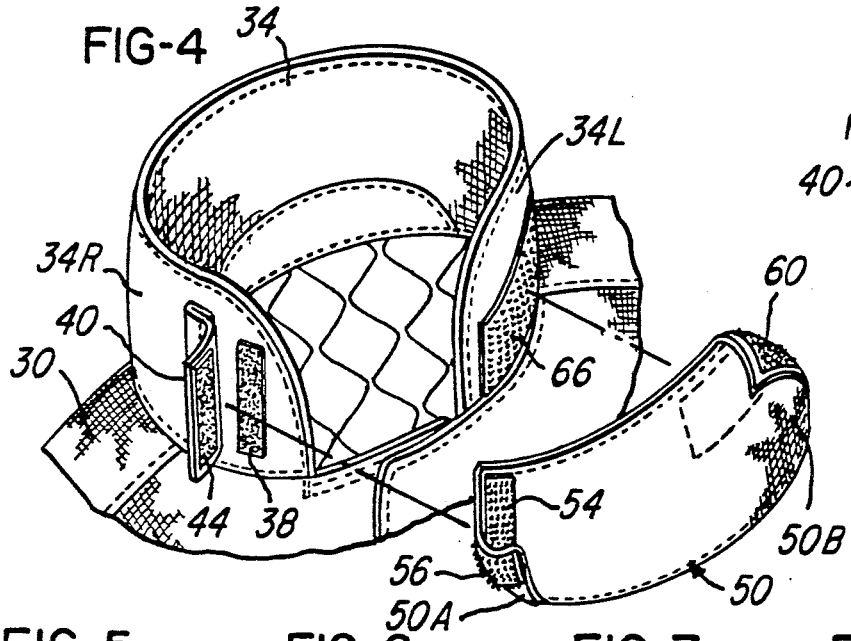
FIG. 4 is an enlarged fragmentary perspective exploded view showing the chinstrap of this invention and means for attachment of the chinstrap to the collar of a firefighter's coat.
Figure 3:
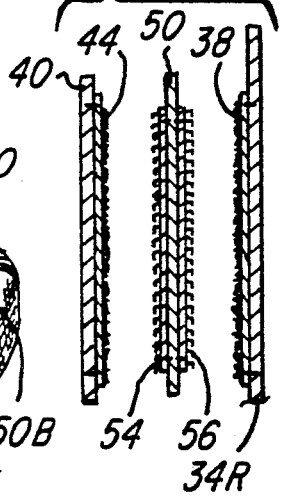
FIG. 3 is an enlarged exploded sectional view taken substantially on line 3—3 of FIG. 2.

The chinstrap 50 also has an end portion 50B which is opposite the end portion 50A. A body 60 of hook and pile material is secured to the end portion 50B of the chinstrap 50. A complementary body 66 of hook and pile material is secured to the left side portion 34L of the collar 34. Thus, the body 60 of hook and pile material which is secured to the end portion 50B of the chinstrap 50 is releasably and adjustably attachable to the body 66 of hook and pile material which is secured to the left side portion 34L of the collar 34, as shown in FIG. 2.

Figure 5:
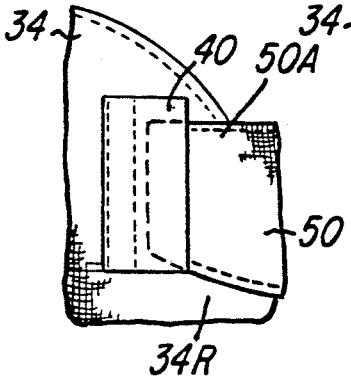
FIG. 5 is a fragmentary elevational view showing a portion of a chinstrap of this invention and attachment thereof to the collar of a firefighter's coat.

FIG. 5 shows the end portion 50A of the chinstrap 50 releasably attached to the right side collar portion 34R, as the chinstrap 50 is positioned adjacent the lower part of the right side collar portion 34R. This position of the chinstrap 50 may be preferable to accommodate a firefighter having a lower or larger chin and neck region than normal.

Figure 6:
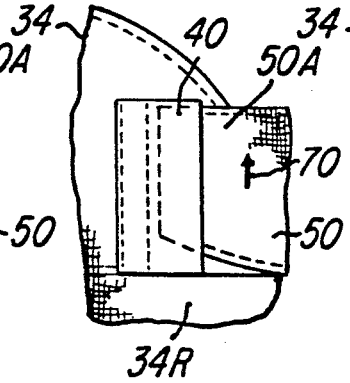
FIG. 6 is a fragmentary elevational view, similar to FIG. 5, showing a portion of the chinstrap of FIG. 5 in an adjusted position.

FIG. 6 shows the end portion 50A of the chinstrap 50 releasably attached to the right side collar portion 34R and adjustably moved upwardly with respect to the collar 34, as illustrated by an arrow 70 in FIG. 6. This, position of the chinstrap 50 may be preferable to accommodate a firefighter having a higher or smaller chin and neck region than normal.

Figure 7:
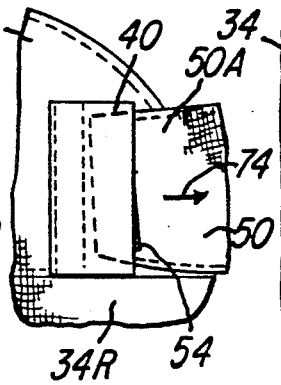
FIG. 7 is a fragmentary elevational view, similar to FIGS. 5 and 6, showing a portion of the chinstrap in another adjusted position.

FIG. 7 shows the end portion 50A of the chinstrap 50 adjustably attached to the right side portion 34R of the collar 34, with the chinstrap 50 adjustably moved slightly to the left with respect to the right side collar portion 34R, as illustrated by an arrow 74 in FIG. 7. This position of the chinstrap 50 with respect to the collar 34 may be preferable to accommodate a firefighter who has a fat or large type of chin and neck region.

Figure 8:
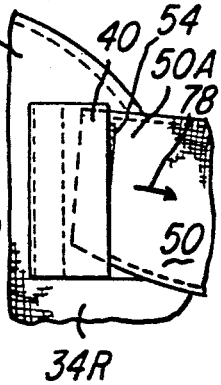
FIG. 8 is a fragmentary elevational view, similar to FIGS. 5, 6, and 7, showing a portion of the chinstrap in another adjusted position.

FIG. 8 shows the end portion 50A of the chinstrap 50 adjustably attached to the right side portion 34R of the collar 34, with the chinstrap 50 angularly moved with respect to the collar 34, as illustrated by an arrow 78 in FIG. 8. This position of the chinstrap 50 may be preferable to accommodate for breathing apparatus or the like adjacent the chin and neck regions of the firefighter.

Thus, it is understood that a firefighter's coat of this invention includes a chinstrap which is readily adjustable to any one of a multiplicity of positions with respect to the collar of the firefighter's coat to which the chinstrap is attached.

Also, it is to be understood that the chinstrap of the firefighter's coat of this invention is readily removable from the collar of the firefighter's coat and replaceable upon the collar of the firefighter's coat. Therefore, within the scope of this invention, any chinstrap of this invention can be readily replaced by another chinstrap of this invention. Such replacement chinstrap may be desired if the original chinstrap should become damaged. Also, a given chinstrap may be replaced by a chinstrap which has a size or shape or other physical qualities which are more desirable for a specific situation in which the firefighter may be involved.

Although the preferred embodiment of a firefighter's coat having an adjustable and removable and replaceable chinstrap of this invention has been described, it will be understood that within the purview of this invention various changes may be made in the form, details, proportion and arrangement of parts, the combination thereof, and the mode of use, which generally stated consist in a structure and method within the scope of the appended claims.

The invention having thus been described, the following is claimed:

1. A firefighter's protective garment comprising a firefighter's coat which includes firefighting protective material, the firefighter's coat including a collar portion having a pair of spaced-apart sections, hook and pile attachment means secured to the spaced-apart sections of the collar portion, a chin and neck protective member, the chin and neck protective member having a pair of spaced-apart sections, complementary hook and pile attachment means secured to the spaced-apart sections of the chin and neck protective member, whereby the chin and neck protective member is releasably attached to the collar portion of the firefighter's coat, one of the spaced-apart sections of the collar portion of the firefighter's coat being a connection section, a flap element secured to the connection section of the collar portion of the firefighter's coat, hook and pile attachment material secured to the flap element and to the connection section of the collar portion adjacent the flap element, one of the spaced-apart sections of the chin and neck protective member being a connection section and having a pair of opposed surfaces, hook and pile attachment material secured to both of the opposed surfaces of the connection section to the chin and neck protective member, the connection section of the chin and neck protective member being positioned between the flap element and said connection section of the collar portion and attachable to the hook and pile attachment material which is secured thereto, whereby the connection section of the chin and neck protective member is firmly positioned between the flap element and said connection section of the collar portion of the firefighter's coat, and whereby the connection section of the chin and neck protective member is releasably attached to the connection section of the collar portion of the firefighter's coat.

2. A firefighter's protective garment comprising a firefighter's coat which includes firefighting protective material, the firefighter's coat including a collar portion having a pair of spaced-apart sections, hook and pile attachment means secured to the spaced-apart sections of the collar portion, a chin and neck protective member, the chin and neck protective member having a pair of spaced-apart sections, complementary hook and pile attachment means secured to the spaced-apart sections of the chin and neck protective member, whereby the chin and neck protective member is releasably attached to the collar portion of the firefighter's coat, the firefighter's protective garment also including a flap element which is secured to one of the spaced-apart sections of the collar portion of the firefighter's coat, a first body of hook and pile material, the first body of hook and pile attachment material being secured to the flap element, a second body of hook and pile material, the second body of hook and pile attachment material being secured to said section of the collar portion of the firefighter's coat adjacent the flap element, one of the spaced-apart sections of the chin and neck protective member being a connection section and having a pair of opposed surfaces, there being a first surface and a second surface, a first hook and pile attachment element, the first hook and pile attachment element being secured to the first surface of the connection section of the chin and neck protective member, a second hook and pile attachment element, the second hook and pile attachment element being secured to the second surface of the connection section of the chin and neck protective member, the connection section of the chin and neck protective member being positioned between the flap element and the second body of hook and pile attachment material, whereby the first hook and pile attachment element which is secured to the first surface of said connection section of the chin and neck protective member is releasably attached to the first body of hook and pile attachment material which is secured to the flap element, and whereby the second hook and pile attachment element which is secured to the second surface of said connection section of the chin and neck protective member is releasably attached to the second body of hook and pile attachment material which is secured to said section of the collar portion adjacent the flap element, and whereby the connection section of the chin and neck protective member is firmly positioned between the flap element and said section of the collar portion of the firefighter's coat, and whereby the connection section of the chin and neck protective member is releasably attached to the flap element and to said section of the collar portion of the firefighter's coat.

3. The method of attaching a chin and neck protective member to a firefighter's coat in which the firefighter's coat includes means forming a neck opening in the firefighter's coat, comprising securing a hook and pile attachment element to the firefighter's coat adjacent the neck opening, providing a chin and neck protective member, securing a body of hook and pile material to the chin and neck protective member, attaching the body of hook and pile attachment material which is secured to the chin and neck protective member to the hook and pile attachment element which is secured to the firefighter's coat adjacent the neck opening, whereby the chin and neck protective member is releasably attached to the firefighter's coat adjacent the neck opening, the neck opening of the firefighter's coat including a collar portion which is provided with a connection section, and in which the method includes securing a flap member to the connection section of the collar portion of the firefighter's coat, securing a hook and pile attachment element to the flap member, securing a hook and pile attachment element to the connection section of the collar portion adjacent the flap member, positioning a portion of the chin and neck protective member between the hook and pile attachment element which is secured to the flap member and the hook and pile attachment element which is secured to the connection section of the collar portion adjacent the flap member, followed by attaching said portion of the chin and neck protective member to the hook and pile attachment element which is secured to the flap member and the hook and pile attachment element which is adjacent the flap member.

* * * * *